US005165676A

United States Patent [19]

Blessing et al.

[11] Patent Number: 5,165,676

[45] Date of Patent: Nov. 24, 1992

[54] FABRIC STACK SHINGLER

[75] Inventors: Hubert Blessing, Dallas; Lawrence Wafford, Jr., Mesquite; Ted M. Ray, McKinney; E. Lennart Lindstedt, Richardson, all of Tex.

[73] Assignee: Levi Strauss & Co., San Francisco, Calif.

[21] Appl. No.: 794,787

[22] Filed: Nov. 19, 1991

Related U.S. Application Data

[63] Continuation of Ser. No. 479,472, Feb. 13, 1990, abandoned.

[51] Int. Cl.[5] ..... B65H 5/02

[52] U.S. Cl. ..... 271/273; 271/151; 271/198; 414/907

[58] Field of Search ..... 271/149, 151, 198, 202, 271/161, 273, 216; 414/907; 270/203

[56] References Cited

U.S. PATENT DOCUMENTS

| | | | |
|---|---|---|---|
| 4,214,744 | 7/1980 | Evans | 271/216 X |
| 4,385,757 | 5/1983 | Müller | 271/216 X |
| 4,436,302 | 3/1984 | Frye et al. | 271/202 |
| 4,443,287 | 4/1984 | Worni | 271/202 X |
| 4,534,550 | 8/1985 | Reist | 271/270 X |
| 4,718,656 | 1/1988 | Reist | 271/202 X |
| 4,905,981 | 3/1990 | Reist | 271/202 X |

FOREIGN PATENT DOCUMENTS

| | | | |
|---|---|---|---|
| 47803 | 3/1978 | Fed. Rep. of Germany | 414/907 |
| 48506 | 6/1985 | Japan | 271/161 |
| 48303 | 3/1983 | U.S.S.R. | 271/161 |

*Primary Examiner*—H. Grant Skaggs
*Assistant Examiner*—Carol Lynn Druzbick
*Attorney, Agent, or Firm*—Haverstock, Medlen & Carroll

[57] ABSTRACT

A method and apparatus for disclosed for shingling stacks composed of flexible planar objects, such as fabric workpieces. The stack is placed over an axis connecting two hinged support surfaces which are rotated relative to one another to bend the workpieces and form a shingle. For subsequent shingling, the rough shingled stack is driven on a conveyor under a series of spreading rollers having positive pressure to drive the rollers onto the stack.

16 Claims, 3 Drawing Sheets

FABRIC STACK SHINGLER

This is a continuation of co-pending application Ser. No. 07/479,472 filed on Feb. 13, 1990, now abandoned.

FIELD OF THE INVENTION

This invention relates generally to the handling of flexible planar objects, and more particularly to the shingling of such objects when presented in stack form.

BACKGROUND OF THE INVENTION

Industrial manufacturing of a garment currently requires an inordinate amount of time to handle material that will eventually comprise a garment. In excess of 80% of the time spent on any one garment may go to material handling. Sewing, for example, represents a surprisingly small proportion of manufacturing time, relative to handling. One area of the process that is particularly time-consuming is separation of a stack of fabric workpieces to allow easy subsequent handling of individual workpieces.

A workpiece stack can be created by repeatedly folding a piece of fabric onto itself and then cutting a single pattern clear through all layers of the multiple-folded cloth. This produces a stack comprised of flexible planar objects of uniform size, oriented such that all edges of each object are juxtaposed with the corresponding edges of each immediately adjacent object. This arrangement produces a stack with ends defined by the two outermost planar objects, and sides defined by the juxtaposed edges of the several juxtaposed objects, which sides are all approximately perpendicular to the two parallel planes containing the end members of the stack.

By automating the process by which such stacks are separated, increased efficiency in handling fabric workpieces can be obtained. However, numerous difficulties are encountered in attempting to automate the separation of flexible planar objects. Unlike the rigid planar objects to which much of the prior art is addressed, stacks of flexible objects easily lose a workable shape if their movement is not strictly controlled. Thus, flexible objects cannot be expected to "fall into place" of their own accord, a characteristic upon which art such as U.S. Pat. Nos. 4,008,890 (PULDA) and 4,049,259 (VENTZ) depends.

Much of the prior art also relies on minimal cohesion between juxtaposed planar surfaces. Where the planar objects are characterized by more substantial coefficients of friction, however, individual sheets are more likely to clump together, resisting current methods of separation. Although some of the art has addressed the "clumping" contingency, it does so only on an "as needed" basis.

It is an object of the present invention to prepare stacks of flexible planar objects for subsequent automated separation by shingling the stack. Once the stack is shingled, an edge of each individual workpiece is exposed for easier handling. A further objective is to carry out this function in a manner which at all times controls the stack such that neither the stack nor the flexible planar objects composing said stack lose a workable shape. Additionally, the present invention is designed to prevent clumping entirely so that special time-consuming measures to separate clumps are avoided. Additional objectives, advantages and features of the present invention are explained as part of the following detailed description.

SUMMARY OF THE INVENTION

The foregoing and additional objectives are accomplished to shingle a stack of the type previously described. The present invention subjects the stack to a two-part process. The first step in the process forms an initial shingle and the second step further decreases the amount of overlap between adjacent workpieces. As a result, each workpiece is exposed as each underlying workpiece is displaced relative to its immediate neighbor during the shingling process.

To achieve this goal, the stack is first placed on the platform of the rough shingler assembly. Here, a clamp, or similar means, is applied to the stack, preferably nearer to one end, such that the workpieces are immobilized relative to one another within a region near the clamp. The rough shingler then bends the stack. To accommodate the fold while conforming to the shape of surrounding workpieces, each workpiece shifts laterally relative to adjacent workpieces at the end of the stack past the bend and opposite the clamp. However, the clamp prevents any such shift or displacement within the region of the stack to which it is applied. To maintain the displacement, the other end of the stack is clamped. The first clamp is released and the stack is then unbent. The initial displacement has been carried through the entire stack.

This process may be repeated indefinitely, so long as the top workpiece in the stack continues to overlap the bottom workpiece and both clamps firmly hold both top and bottom workpieces. The longer the workpieces relative to the distance between the clamps and the thickness of the stack the more the stack can be shingled.

Where the rough shingler cannot operate to provide sufficient shingling, further processing is necessary. To complete the shingling process, the rough shingled stack is next treated by a spreader assembly. The spreader assembly includes at least one roller subassembly positioned above a conveyor belt on which the partially shingled stack is riding. The axle of the roller subassembly lies in a plane parallel to the conveyor and at an angle perpendicular to the direction of the conveyor belt. The stack is positioned upon the conveyor so that its open side faces the roller subassemblies and the direction of the conveyor. In the open side of a shingled stack each underlapping workpiece is exposed. In the closed side, each underlapping workpiece is hidden.

A preshingled stack is driven under a roller subassembly or series of subassemblies. As the conveyor carries the stack beneath a roller subassembly, the subassembly is lowered so that the rollers of the subassembly are brought into contact with the open side of the stack. The rollers operate to recline and further shingle the stack. They do so by a combination of roller rotation in the same direction as the direction of the stack in combination with the application of pressure onto the shingled stack.

BRIEF DESCRIPTION OF THE DRAWINGS

The preferred embodiment of the invention is described in detail below in conjunction with the illustrations in which.

DETAILED DESCRIPTION OF A PREFERRED EMBODIMENT

Figure 1:
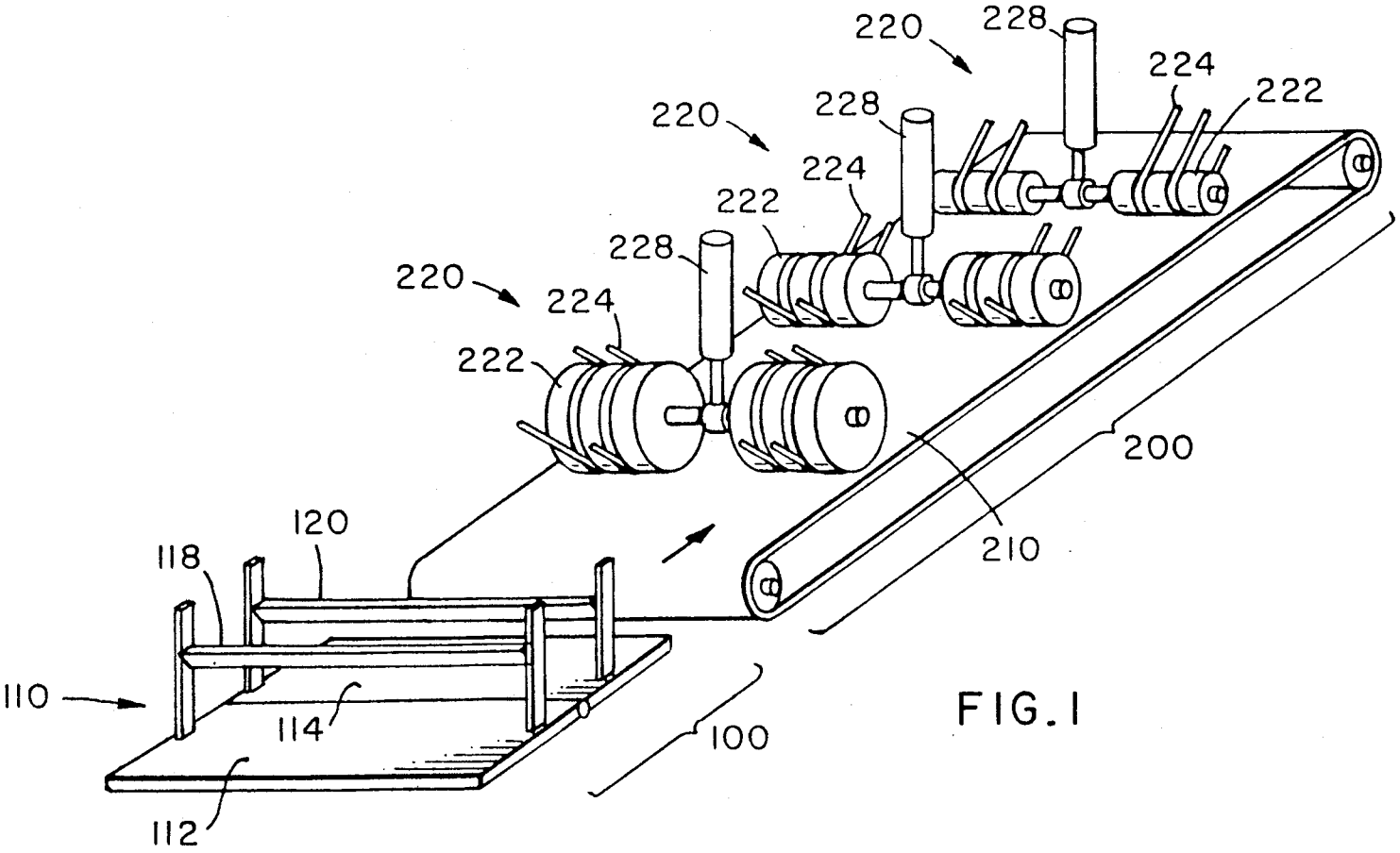
FIG. 1 is a perspective view of the rough shingler assembly in combination with the spreader assembly.

FIG. 1 illustrates one arrangement of the preferred embodiment. This arrangement demonstrates a close spacial proximity that is appropriate for rough shingler assembly 100 and spreader assembly 200, in view of the close temporal proximity in which the two assemblies operate during the particular shingling process disclosed herein, as well as in the overall manufacturing process.

In this arrangement, a fabric workpiece stack is placed upon rough shingler platform 110. The rough shingler platform 110 comprises two adjoining subplates, primary subplate 112 and secondary subplate 114. The axis 116 of the platform 110 joins the two subplates 112 and 114. A primary clamp 118 is positioned to clamp a stack 122 of objects against the primary subplate 112 and a secondary clamp 120 is positioned to clamp the same stack 122 against the secondary subplate 114. The sides of the stack which will be offset in a shingled fashion are preferably parallel to the axis 116.

Figure 2A:
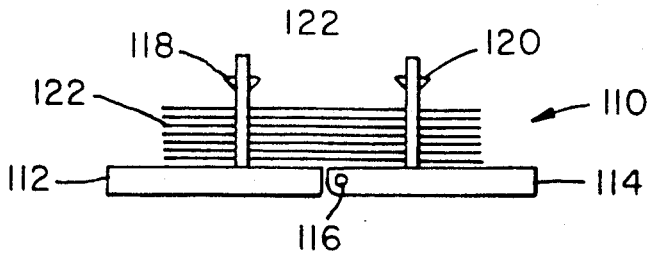
FIG. 2A through 2F show the steps necessary to rough shingle a stack of fabric workpieces.
Figure 2B:
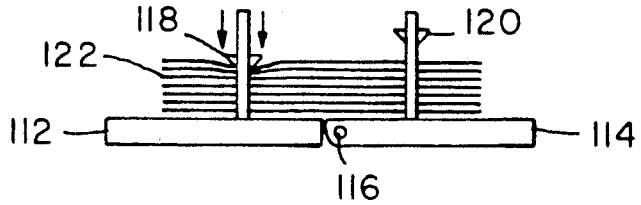

FIGS. 2A through 2F show the sequence of steps taken by the rough shingler 100. FIG. 2A shows that a workpiece stack has been delivered to the platform 110. This may be done through any standard means such as by a conveyor. The stack 120 straddles the axis 116 and is positioned under both primary clamp 118 and secondary clamp 120. In FIG. 2B, the primary clamp 118 is activated to firmly grasp the stack 122. The activation of the clamps may be controlled by mechanical, pneumatic, hydraulic or other means and is preferably automatically controlled. This action holds the workpieces in the stack immobile relative to one another in the region near to the primary clamp 118.

Figure 2C:
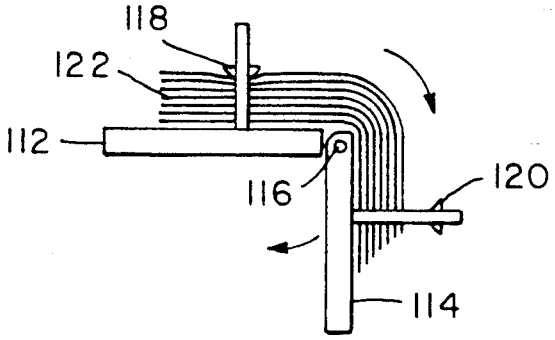

In FIG. 2C the secondary subplate 114 is rotated about the axis 116 bending the workpieces. The subplate 114 may be controlled by mechanical, pneumatic, hydraulic or other means. These control means are preferably automatically actuated in sequence with the clamps. Any suitable control means may be used. Each workpiece is bent around the axis 116. However, each workpiece that is successively farther from the platform 110 is bent through an arc having a larger radius of curvature. Accordingly, because each workpiece is the same length the ends of the stack positioned over the secondary subplate 114 are displaced from one another. The larger the angle that the secondary subplate rotates through, the larger the displacement of the ends of the stack 122.

The ends will be displaced whether the secondary subplate 114 is rotated upward or downward (as shown). It should be noted that if the subplate 114 is rotated upward the open end of the stack will be at the opposite end of the stack. Depending upon the characteristics of the workpiece attempting to rotate the subplate 114 up may tend to buckle the fabric and fail to shingle the stack 122.

Figure 2D:
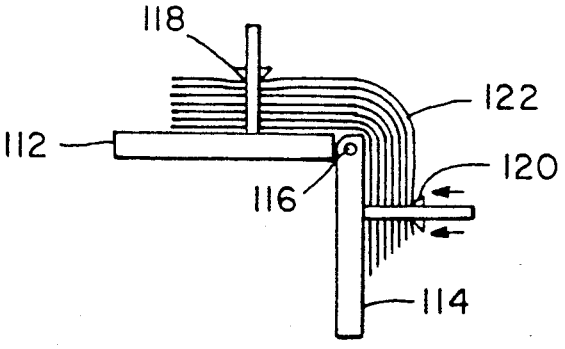
Figure 2E:
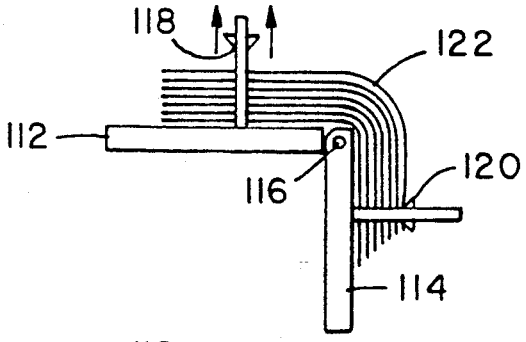
Figure 2F:
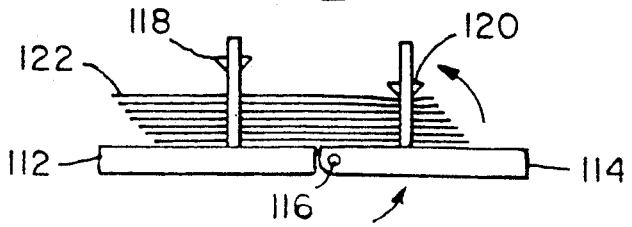

FIG. 2D shows that the secondary clamp 120 is activated to firmly grasp the stack 122. This action holds the workpieces in the stack immobile relative to one another in the region near to the secondary clamp 120. Next, FIG. 2E shows that the primary clamp 118 is deactivated. The workpieces are no longer immobile relative to one another over the primary subplate 112. Lastly, in FIG. 2F, secondary subplate 114 is returned to its starting position parallel to primary subplate 112. Because the workpieces are no longer bent through various radii of curvature the amount displacement between the ends of the stack 122 held by the secondary clamp 120 is transferred throughout the stack 122.

Additional displacement of the workpieces may be obtained by repeating that part of the process described above, so long as previous displacement has not removed any workpieces from the areas subject to detachable affixation by clamps 118 and 120 and so long as the top workpiece still overlies at least in part the bottom workpiece.

Where the workpieces are short in length, such as for blue jean patch pockets, the rough shingling operation may not be able to achieve sufficient shingling for suitable handling in subsequent operations. In such circumstances, the spreader assembly 200 is used to spread the shingled stack out even more. In the preferred embodiment of FIG. 1, the rough shingled stack is transported from the rough shingler 100 to the spreader assembly 200. The stack may be transported by any known method such as a conveyor.

Figure 3:
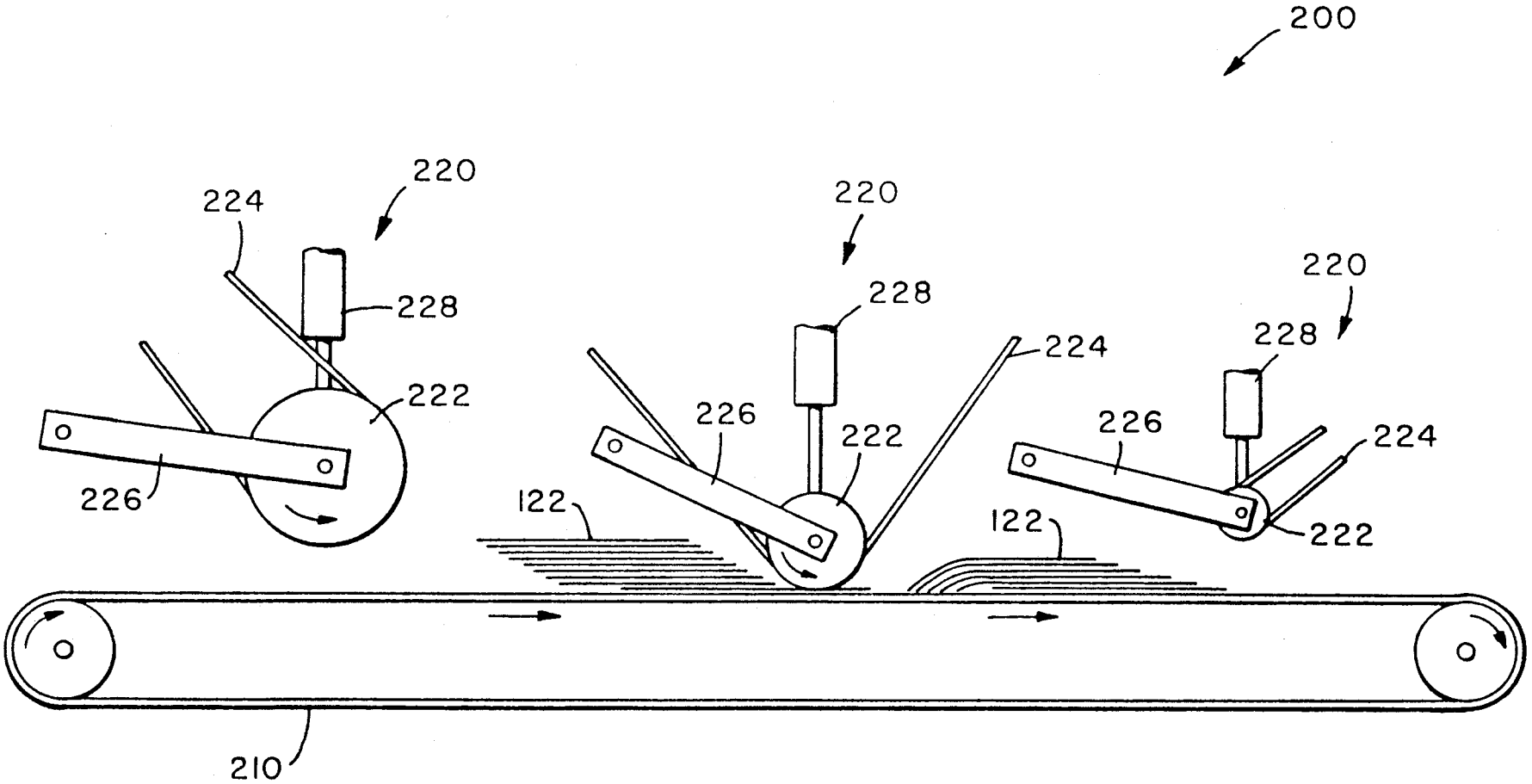
FIG. 3 shows a side view of the spreader assembly with the second roller subassembly engaged.

The spreader assembly 200 shown in FIG. 3 comprises a conveyor 210 which transports the stack 122 therethrough. Additionally, roller assemblies 220 are utilized to spread out the fabric. The roller assemblies include a roller 222 driven by a belt 224 in the direction of the conveyor 210 and supported by a moveable arm 226. Positive pressure is exerted against the conveyor 210 by the roller 222 through an air cylinder 228. Springs, weight or other means may be used.

The open edge of the stack 122 is driven under the roller 222 by the conveyor 210. The stack 122 forces the roller 222 to rise up and ride along the stack 122. Because the workpieces are compressible, a small wave is developed due to the pressure of the roller 222 on the stack 122. This wave is pushed through the stack thereby increasing the amount of shingling (spreading out the stack 122). The size of the rollers 222 are preferably selected to have an appropriate angle of attack to the stack 122 based upon the amount of shingle expected. Thus, rollers of different sizes can be used throughout a single shingle spreader assembly as shown in FIG. 3.

While a particularly preferred embodiment of this invention has been described above in detail, it is understood that this embodiment is illustrative only of the principles of this invention. Numerous equivalents, modifications and variations of the described structure will become readily apparent to those skilled in the art. Thus, the scope of this invention is limited solely by the claims appended hereto.

What is claimed is:

1. An apparatus for spreading a shingled stack of compressible fabric workpieces, the stack having an open face such that each underlying workpiece is exposed, the apparatus comprising:

a. a driven roller;

b. conveyor means to drive the stack under the roller wherein the stack is oriented so that the open face of the stack contacts the roller first;

c. vertically moveable means to apply positive pressure to hold the roller against the conveyor means thereby causing the roller to ride upwardly on the open face and the amount of overlap between successive workpieces in the stack to decrease.

2. The apparatus according to claim 1 wherein the means to drive the stack comprises a single conveyor driven in a direction.

3. The apparatus according to claim 2, including plural driven rollers all disposed over the conveyor.

4. The apparatus according to claim 3, wherein the rollers all have various different diameters, the diameters of the rollers decreasing monotonically along the length of the conveyor in the direction of conveyor motion.

5. The apparatus according to claim 1 wherein the moveable means to apply pressure comprises a hydraulic cylinder.

6. The apparatus according to claim 2 wherein the roller is driven in a complementary direction to the conveyor at a circumferential speed less than a linear conveyor speed.

7. An apparatus for shingling a stack having a plurality of compressible flexible fabric workpieces, the stack further having a first end and a second end, the apparatus comprising:

a. a rough shingler comprising:

(1) means to activate a first means for holding the first end of the stack such that the workpieces are immobile relative to one another at the first end;

(2) means for bending the stack coupled to the means for holding to form a displacement in the workpieces relative to one another at the second end of the stack;

(3) second means for holding the second end of the stack coupled to the means for bending such that the workpieces are immobile relative to one another at the second end to thereby maintain the displacement;

(4) means to deactivate the first means for holding; and (5) means for unbending the stack; and b. a shingle spreader comprising:

(1) a single conveyor means coupled to receive a shingled stack from the rough shingler;

(2) a driven roller positioned over the conveyor means;

(3moveable means to apply pressure to hold tne roller against the conveyor whereby the amount of overlap between successive workpieces is decreased.

8. The apparatus according to claim 7 wherein the means for holding the first end and the means for holding the second end comprise clamps.

9. The apparatus according to claim 8 wherein the means for holding further comprises a first automatic means to active the clamps.

10. The apparatus according to claim 7 wherein the means for bending the stack comprises a fixed primary subplate and a rotating secondary subplate joined together at an axis.

11. The apparatus according to claim 10 wherein the means for bending further comprises a second automatic means to rotate the secondary subplate.

12. The apparatus according to claim 7, including plural driven rollers all disposed over the conveyor means.

13. The apparatus according to claim 12, wherein the rollers all have various different diameters, the diameters of the rollers decreasing monotonically along the length of the conveyor means in a direction of conveyor means motion.

14. A method of spreading a shingled stack of compressible fabric workpieces having an amount of overlap between successive workpieces comprising the steps of:

a. moving the stack on a single conveyor; and b. pressing on the stack as it moves along the conveyor with a vertically movable roller driven to rotate complementary to the conveyor at a circumferential speed less than a linear conveyor speed, whereby the amount of overlap between successive workpieces is decreased.

15. The apparatus according to claim 14, including plural vertically movable rollers all disposed over the conveyor.

16. The apparatus according to claim 15, wherein the rollers all have various different diameters, the diameters of the rollers decreasing monotonically along the length of the conveyor in a direction of conveyor motion.

* * * * *

UNITED STATES PATENT AND TRADEMARK OFFICE

CERTIFICATE OF CORRECTION

PATENT NO. : 5,165,676

DATED : November 24, 1992

INVENTOR(S) : Hubert Blessing, Lawrence Wafford, Jr., Ted M. Ray
E. Lennart Lindstedt It is certified that error appears in the above-identified patent and that said Letters Patent is hereby corrected as shown below:

On the cover page in the Abstract reference block [57], line 1, after "apparatus" and before "disclosed" delete "for" and replace it with -- are --.

Column 6, Line 1 delete "(3moveable" and replace with -- (3) moveable --.

Signed and Sealed this

Fifth Day of October, 1993

Bruce Lehman

*Attest:*

BRUCE LEHMAN

*Attesting Officer*

*Commissioner of Patents and Trademarks*